United States Patent [19]

Moertel

[11] 4,137,608

[45] Feb. 6, 1979

[54] SLIDE FASTENER WITH ADJUSTABLE STOP

[75] Inventor: George B. Moertel, Conneautville, Pa.

[73] Assignee: Textron Inc., Providence, R.I.

[21] Appl. No.: 841,039

[22] Filed: Oct. 11, 1977

[51] Int. Cl.[2] ..... A44B 19/36

[52] U.S. Cl. ..... 24/205.11 R

[58] Field of Search ..... 24/205.11 R

[56] References Cited

U.S. PATENT DOCUMENTS

| | | | |
|---|---|---|---|
| 2,146,691 | 2/1939 | Sundback | 24/205.11 R |
| 2,154,099 | 4/1939 | Marinsky | 24/205.11 R |
| 2,217,571 | 10/1940 | Susskind | 24/205.11 R |
| 2,835,951 | 5/1958 | Sutton | 24/205.11 R |
| 2,988,796 | 6/1961 | Johns | 24/205.11 R |
| 3,903,571 | 9/1975 | Howell | 24/205.11 R |

*Primary Examiner*—Bernard A. Gelak

*Attorney, Agent, or Firm*—O'Brien and Marks

[57] ABSTRACT

A slider stop member has a flexible portion and a channel for slidably receiving coupling elements of a slide fastener. The stop member also has a prong for penetrating into a portion of the slide fastener when the flexible portion is forced inward together with a locking projection or abutment for securing the prong projecting in the slide fastener portion.

10 Claims, 10 Drawing Figures

SLIDE FASTENER WITH ADJUSTABLE STOP

BACKGROUND OF THE INVENTION

1. Field of the Invention

This invention relates to stops for sliders on slide fasteners, and particularly to such stops which can be set at selected positions during or after installation of the slide fastener in an article such as a garment.

2. Description of the Prior Art

The prior art, as exemplified in U.S. Pat. Nos. 2,618,828, 3,555,627, 3,805,339, 3,903,571, 3,905,073, 3,849,841 and 3,953,912 and Canadian Patent No. 619,347, contains a number of stop members for sliders on a slide fastener. The above patents U.S. Pat. Nos. 3,556,627 and 3,805,339 disclose bottom stops which are slidable on fastening elements of zippers and have tabs or deformable portions for being deformed to extend into a space between adjacent fastening elements to set the position of the bottom stops. The above U.S. Pat. Nos. 3,903,571 and 3,953,912 and Canadian Patent No. 619,347 disclose bottom stops which are selectively positioned on slide fasteners and then crimped to secure the bottom stops. The above Patent No. 3,849,841 discloses an adjustable bottom stop adapted to fit over and slide on the fastening elements of a zipper and to be secured in position by stitching. The above U.S. Pat. Nos. 2,618,828 and 3,905,073 disclose top stops for slide fasteners having metal members which are received in the spaces between adjacent fastening elements and are crimped to secure the members in place. All of these prior art stops require the use of special tools or time consuming procedures for securing the top stop in a selected position on the slide fastener.

SUMMARY OF THE INVENTION

The invention is summarized in a slide fastener with an adjustable stop including a pair of planarly disposed carrier tapes, a pair of coupling means secured to respective inner longitudinal edges of the pair of tapes, a slider slidably mounted on the pair of coupling means for opening and closing the slide fastener, a slider stop member having a flexible portion and a channel for receiving at least one of the pair of coupling means, the stop member having a prong extending inward for penetrating into a portion of the slide fastener when the flexible portion is forced inward, and locking abutment means for securing the prong penetrating into the slide fastener portion.

An object of the invention is to construct a slide fastener with a top stop and/or a bottom stop which is adjustably located upon the fastener and can be easily secured in position.

Another object of the invention is to construct a slider stop which can be secured upon the slide fastener by finger pressure during or after the installation of the slide fastener in an article or garment.

One advantage of the invention is that a slide fastener may be installed within an article or garment while the slider is located away from the attachment area such as away from the lines of stitches being applied.

Another advantage of the invention is that the stop member may be applied to the slide fastener after the slide fastener is attached to an article permitting the accurate placement of the stop member in accordance with the requirements of the article.

An additional feature of the invention contemplates the employment of a laterally extending locking projection on the end of a prong for insertion in the spaces between convolutions of a coil coupling element so that the projection engages within the opening through the center of the convolution to secure the stop on the slide fastener.

Other objects, advantages and features of the invention will be apparent from the following description of the preferred embodiment taken in conjunction with the accompanying drawings.

DESCRIPTION OF THE PREFERRED EMBODIMENTS

Figure 1:
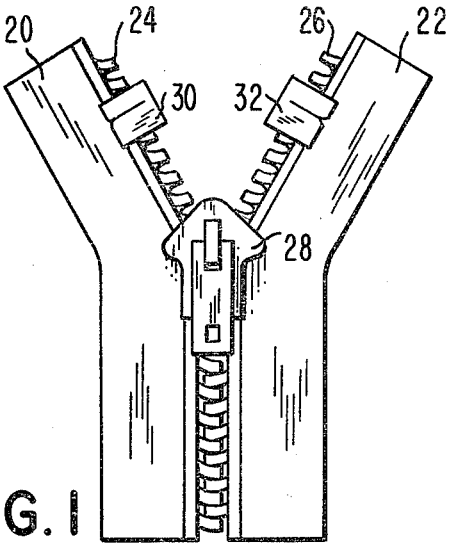
FIG. 1 is a plan view of a slide fastener constructed in accordance with the invention.
Figure 2:
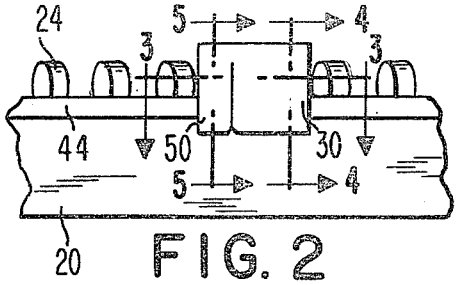
FIG. 2 is an enlarged plan view of a broken away portion including a top stop of the fastener of FIG. 1.
Figure 3:
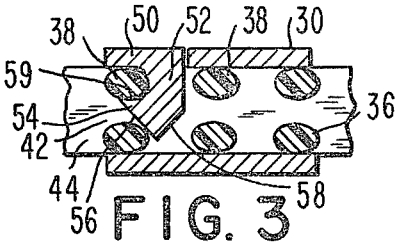
FIG. 3 is a cross section view taken along line 3—3 of FIG. 2.
Figure 4:
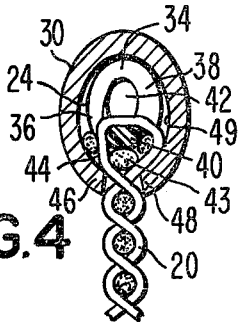
FIG. 4 is a cross section view taken along line 4—4 of FIG. 2.
Figure 5:
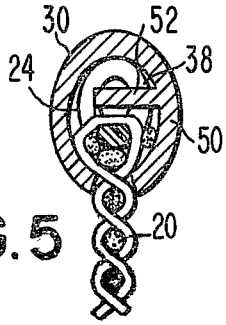
FIG. 5 is a cross section view taken along line 5—5 of FIG. 2.

As shown in FIG. 1, the invention is embodied in a slide fastener including a pair of planarly disposed carrier tapes 20 and 22 with coupling elements 24 and 26 secured to the inner edges of the respective tapes 20 and 22. A slider 28 is slidably mounted on the coupling elements 24 and 26 for opening and closing the slide fastener. A pair of top stops 30 and 32 are fastened to the respective coupling elements 24 and 26 adjacent their top end.

The tape 20, the coupling element 24 and the top stop 30 are mirror images of the tape 22, the coupling element 26 and the top stop 32. Thus only the tape 20, coupling element 24 and top stop 30 are illustrated in detail in FIGS. 2–6.

The tape 20 and the coupling element 24 are conventional slide fastener components well known in the art. The coupling element 24 is illustrated as being a spiral-type coupling element formed from a filament which is suitably coiled and deformed to form successive convolutions. Each convolution includes a head portion 34, a pair of leg portions 36 and 38 extending from respective opposite sides of the head portion 34, and a heel or interconnecting portion 40 joining the convolution to an adjacent convolution. The spiral 24 forms a central opening 42 bordered in each convolution by the pair of leg portions 36 and 38 and the head portion 34. The illustrated tape 20 is a woven tape having a weft or filler thread interwoven with warp threads and around the interconnecting portions 40 and a warp cord 43; the cord 43, several of the warp threads and a portion of the interwoven weft thread form a conventional bead 44 supporting the coupling element 24. Other conventional coupling elements and tapes may be employed in place of the described spiral coil coupling element 24 and woven tape 20.

The top stop 30 is formed by conventional techniques from a thermoplastic colored to match the slide fastener and has a length extending over two or more of the convolutions of the coupling element 24. The stop 30 has a C-shaped cross section as viewed in FIG. 4 extending around the coupling element 24 and the bead 44; thus forming a channel 49 receiving the coupling element 24 and the bead 44. Edges 46 and 48 of the stop 50 extend adjacent the tape 20 next to the bead 44 to resist removal of the stop 30 laterally relative to the edge of the tape 20. A portion 50 of the stop 30 is flexible, or is flexibly hinged on the remaining portion of the stop 30. A prong 52 extends inward from the portion 50 and terminates in an end which includes a lateral projection or hook 54 extending into the opening 42 between the leg portions 36 and 38 of one convolution of the coupling element 24. The projection 54 has a forward or inner surface 56 which is canted so as to cam the legs 38 of adjacent convolutions apart permitting insertion of the prong 52 between the leg portions 38. An oppositely canted surface 58 on the opposite side of the end of the prong 52 is provided to also aid in the separation of the adjacent convolutions in insertion of the prong 52. An inner or upper surface 59 of the projection 54 is formed substantially parallel to the longitudinal dimension of the tape and coupling element 24 so as to lockingly abut or engage the inside of the leg portion 38 to prevent removal and secure the prong 52 penetrating into the coupling element.

Figure 6:
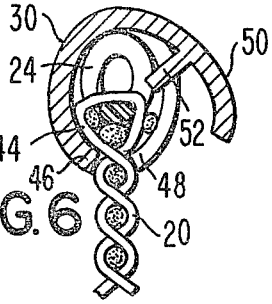
FIG. 6 is a view similar to FIG. 6 but prior to securing the stop of the slide fastener.

In installation and use of the top stop 30, the top stop 30 is initially positioned over the coupling elements 24 either by sliding the top stop 30 over the open end of a slide fastener, or by spreading the edges 46 and 48 apart resiliently to position the stop 30 with the coupling element 24 and bead 44 received within the channel 49. Initially the flexible portion 50 is bent outward as shown in FIG. 6 leaving the prong 52 outside of the coupling element 24. In this position the stop 30 is slid along the coupling element 24 to the desired position. Then pressure exerted by squeezing the stop 30 and the flexible portion 50, such as with fingers, causes the camming surfaces 56 and 58 on the end of the prong 52 to resiliently force the legs 38 of adjacent convolutions of the coil 24 apart and permit the prong 52 to be inserted between the adjacent convolutions. Once the projection 54 passes the inside surface of the leg 38, the legs 38 close capturing and securing the prong 54 by the leg 38 engaging the abutment surface 59. Thereafter the stop 30 is secured in position to form a stop for the slider 28. This stop 30 with the similarly installed stop 32 then operate in a conventional manner as other top stops in the prior art to limit upward travel of the slider 28.

The stops 30 and 32 may be positioned and secured to the slide fastener after it is attached or sewn to an article such as a garment. This permits acurate placement of the stops 30 and 32 as well as attachment of the slide fastener with the stops temporarily positioned away from the stitching or other attaching means.

Figure 7:
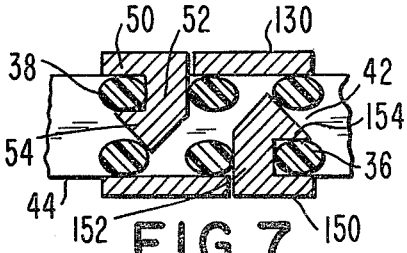
FIG. 7 is a view similar to FIG. 3 of a modified top stop on a slide fastener.

In a modified top stop 130 shown in FIG. 7, there is included a second flexible portion 150 carrying a prong 152 which has a projection 154, substantially similar to and in addition to the flexible portion 50, prong 52 and projection 54 previously described. The flexible portion 150 and prong 152 are located on the opposite side of the top stop 130 from the flexible portion 50 and prong 52 so that the prong 152 will be inserted between the legs 36 rather than the legs 38. Also the flexible portions 150 and 50 and the prongs 52 and 152 are positioned on opposite ends of the top stop 130 so as to be inserted between different pairs of adjacent convolutions of the coupling element 24. The use of two prongs and locking projections instead of one as in the embodiments of FIGS. 2–6 results in increased security in locking of the top stop on the slide fastener.

Figure 8:
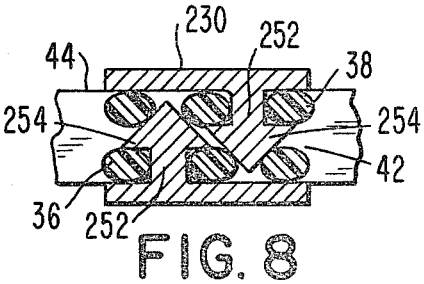
FIG. 8 is a view similar to FIGS. 3 and 7 but of a still further modified top stop on a slide fastener.

In a second modified top stop 230 illustrated in FIG. 8, a pair of prongs 252 are mounted directly on the opposite side walls of the C-shaped top stop. Each prong 252 has two locking projections 254 extending in opposite directions from each prong 252 along the axis of the coil coupling element 24 into the central openings between the leg portions 36 and 38. The sides of the stop 230 are resilient and permit the top stop 230 to be forced over the coupling element from the inner edge and then squeezed to insert the prongs 252 between the respective leg portions 36 and 38. The top stop 230 has the advantage of being relatively rigid and more firmly secured on the slide fastener but has the disadvantage of being not readily slidably on the spiral coupling element and thus is best installed over the edge of the spiral coupling element.

Figure 9:
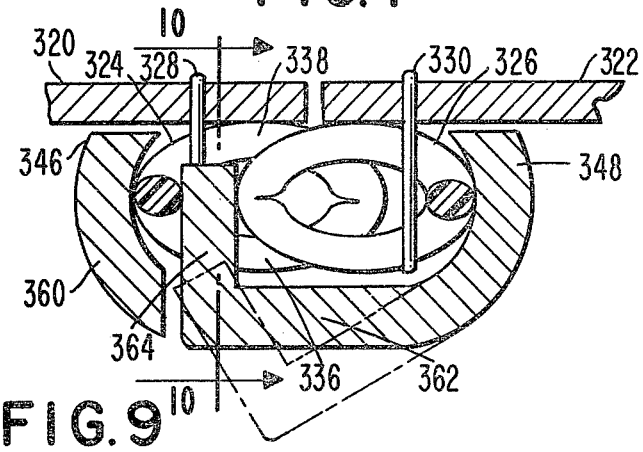
FIG. 9 is a cross section view of a bottom stop on a invisible-type slide fastener in accordance with the invention.
Figure 10:
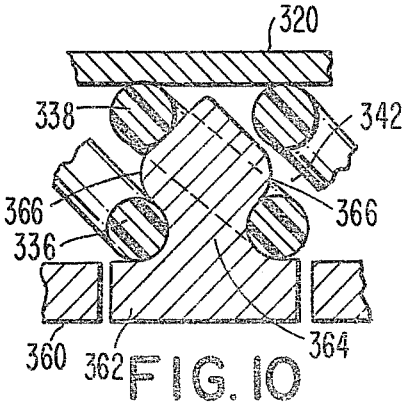
FIG. 10 is a cross section view taken along line 10—10 of FIG. 9.

An enlarged portion of an invisible-type slide fastener is illustrated in FIGS. 9 and 10. The invisible-type slide fastener includes tapes 320 and 322 and interlocking ladder-coil-type coupling elements 324 and 326 attached to the bottom sides of the inner edges of the respective tape 320 and 322 by suitable means such as stitches 328 and 330. A bottom stop 360 is secured on the interlocking elements 320 and 326. The tapes 320 and 322 and the round coil ladder type coupling elements 324 and 326 are illustrative of many various types of invisible type slide fasteners upon which the bottom stop 360 can be attached.

The bottom stop 360 has a cross-sectional C-shape as viewed in FIG. 9 with edges 346 and 348 extending on top of the interlocking coupling elements 324 and 326 to secure the bottom stop 360 slidably on the coupling elements 324 and 326. The stop 360 has a flexible portion 362 supporting a prong 364 which may be inserted between legs 336 of adjacent convolutions of one of the coupling elements 324 and 326 to insert locking projections 366 within the eyes or openings formed between the leg portions 336 and 338.

The bottom stop 360 is installed by slidably positioning the stop 360 over the interlocking coupling elements 324 and 326 at a selected position. Then the flexible portion 362 is pressed by finger pressure to insert the prong 362 between the legs 336 to result in the projections 366 abutting the inside surfaces of the legs 336 to lock and secure the stop 360 in the selected position. The bottom stop 360 secured in the selected position operates in a manner similar to conventional bottom stops to limit movement of a slider on the slide fastener.

Since many modifications, variations and changes in detail may be made to the present invention, it is intended that all matter in the foregoing description or shown in the accompanying drawings be interpreted as illustrative and not in a limiting sense.

What is claimed is:

1. A slide fastener with an adjustable stop comprising
a pair of planarly disposed carrier tapes,
a pair of coupling means secured to respective inner longitudinal edges of the pair of tapes,
a slider slidably mounted on the pair of coupling means for opening and closing the slide fastener, a slider stop member having a flexible portion and a channel for receiving at least one of the pair of coupling means, said stop member having a prong extending inward for penetrating into a portion of the slide fastener when the flexible portion is forced inward, a lateral projection on the end of the prong for resiliently displacing the penetrated portion of the slide fastener as the lateral projection passes the penetrated portion, and said lateral projection having a rearward abutment surface for engaging the displaced portion when the displaced portion returns after passage of the lateral projection to secure the prong in the penetrating position.

2. A slide fastener as claimed in claim 1 wherein the prong is mounted on the flexible portion.

3. A slide fastener as claimed in claim 2 wherein the coupling means received within the channel has a central opening, and the lateral projection on the end of the prong interlocks with the central opening of the coupling means.

4. A slide fastener as claimed in claim 3 wherein the prong has a camming surface on its distal end for forcing the coupling means apart.

5. A slide fastener as claimed in claim 1 wherein the stop member has a second prong, the first and second prongs extending inward from respective opposite sides and from respective opposite ends of the stop member for penetrating into spaced portions of the slide fastener.

6. A slide fastener as claimed in claim 5 wherein the coupling means received within the channel includes a central opening, the second prong has a lateral projection, and the lateral projections on the respective first and second prongs extend into the central opening of the coupling means.

7. A slide fastener as claimed in claim 6 wherein each prong includes a second lateral projection extending opposite to the first lateral projection of each prong.

8. A slide fastener as claimed in claim 1 wherein the stop member is a top stop, the coupling means on each tape is a spiral element having a central opening through each convolution, the tape has a bead supporting the spiral element, the stop member is an elongated member with a C-shaped cross section forming a longitudinal channel slidably receiving the bead and the spiral element, the flexible portion is a separate portion of the elongated member having the prong mounted thereon for insertion between adjacent convolutions of the spiral element, the lateral projection on the end of the prong interlocks in the central opening of a convolution of the spiral element, and the prong has a camming surface on its end for forcing a pair of convolutions apart during insertion of the prong.

9. A slide fastener as claimed in claim 1 wherein the stop member is a bottom stop having a channel for receiving both coupling means when interlocked.

10. A slide fastener as claimed in claim 9 wherein each coupling means includes a coil coupling element, the prong extends from the flexible portion, and the projection on the end of the prong is received in the center of one convolution of one of the coil coupling elements.

* * * * *